US005386778A

United States Patent [19]

Sullivan, Jr.

[11] Patent Number: 5,386,778

[45] Date of Patent: Feb. 7, 1995

[54] PROCESS FOR VISUALIZATION OF A BLAST WAVE

[75] Inventor: John D. Sullivan, Jr., Edgewood, Md.

[73] Assignee: The United States of America as represented by the Secretary of the Army, Washington, D.C.

[21] Appl. No.: 3,063

[22] Filed: Jan. 11, 1993

[51] Int. Cl.[6] ..... F42D 3/00; F42B 13/44

[52] U.S. Cl. ..... 102/302; 102/311; 102/334

[58] Field of Search ..... 102/302, 311, 334

[56] References Cited

U.S. PATENT DOCUMENTS

| | | | |
|---|---|---|---|
| 2,925,038 | 2/1960 | Walker | 102/302 X |
| 3,992,628 | 11/1976 | Karney | 250/338 |
| 4,976,202 | 12/1990 | Honigsbaum | 102/367 |
| 5,255,125 | 10/1993 | Hale et al. | 359/889 |

OTHER PUBLICATIONS

Schlieren Photography, Eastman Kodak Co., 1974, p. 3.
Fluid Mechanics, Raymond C. Binder, Prentice-Hall, 4th ed., pp. 283, 604–607.
Engineering Design Handbook, Explosions in Air, Part One, AMCP 706-181, 1974, pp. 9–15 to 9–21.
Technical Report, ARBRL-TR-02555, Apr. 1984, pp. 18–19.

*Primary Examiner*—Peter A. Nelson
*Attorney, Agent, or Firm*—Freda L. Krosnick; Walter R. Baylor; Frank J. Dynda

[57] ABSTRACT

A process for visualization of a blast wave, which is the shock wave resulting from an explosive charge, is practiced by observing disturbance contours on a liquid-air cloud and interpreting resulting graphical and calculated data to evaluate matters related to the explosive blast wave.

9 Claims, 2 Drawing Sheets

PROCESS FOR VISUALIZATION OF A BLAST WAVE

RIGHTS OF THE GOVERNMENT

The invention described herein may be manufactured, used, and licensed by or for United States Governmental purposes without payment to us of any royalty thereon.

BACKGROUND OF THE INVENTION

1. Field of Invention

The present invention relates to a process for visualization of a blast wave which is the shock wave from an explosion.

2. Description of the Prior Art

The present invention relates to visualization of the shock wave propagating away from an explosion. The invention does not relate to subsonic or supersonic flows nor does it relate to shock waves surrounding supersonic bodies. Nevertheless, the common intent of visualization may create the impression that the techniques are anticipations of the present invention—they are not.

There is a wide assortment of techniques for visualizing air flows and shock wave passages. Flow visualization techniques include: a windsock at the airport; an injection of smoke into an airflow; a blowing of dye to stain a model body; a positioning of an array of ribbons in the airflow; an injection of traces of dye or small bubbles into a flowing liquid; and examples in shadowgraphy and schlieren photography (with and without laser illumination).

Flow visualization techniques are not prior art for this invention. However, gas flowing at supersonic speed does exhibit a shock wave pattern in angled duct, such as a jet engine inlet, in which it flows; also a shock pattern exists around a supersonic projectile that is moving in air or conversely. These techniques need to be mentioned because the shock visualization techniques in the supersonic flow problems are sometimes repeated in blast wave problems.

Schlieren photography has become a nearly indispensable tool for investigating the flow of gases. An aeronautical engineer uses the schlieren technique to find valuable information about shock waves accompanying projectiles. A combustion engineer uses the schlieren technique in studying how fuels burn and investigations of heat transfer are aided by the ability of schlieren photography to show the paths taken by air over a hot surface. In general, the schlieren technique can be used to advantage whenever it is desirable to visualize the flow of gases. Being optical, the schlieren process does not interfere with the subject being observed. Normal motion of gases is not impeded, as is the case when Pitot tubes or yaw heads are inserted in the gas stream to detect flow direction. Optical methods involving an interferometer and shadow photography are also commonly used for visualizing gas flow. The interferometer has the characteristic of producing an image in which the differences in density are proportional to the differences in refractive index in the field. Thus, it is adaptable to quantitative measurements. A major disadvantage of the interferometer for investigating gas flow is its high cost. Also much care must be taken in adjusting the instrument, and the results are usually difficult to interpret. Shadow photographs, on the other hand, are easily taken with a minimum of equipment, but the results are not very useful unless the subject has strong gradients in the index of refraction. Schlieren photography, intermediate between these two extremes, indicates the gradient in refractive index. Combination of the three methods sometimes are used; (SCHLIEREN PHOTOGRAPHY, Eastman Kodak Company Publication P-11, 1974, page 2).

Motion picture photography has utilized smoke trails from rockets to determine time histories of particle velocity behind the blast front. Displacement of these smoke trails can be seen clearly in FIG. 9—23. (ENGINEERING DESIGN HANDBOOK, "Explosions in Air, Part One" AMCP 706-181, chapter 9, pages 17–18). The shock wave pattern surrounding a projectile is favorably visualized with shadow photography. Examples from the U.S. Army Ballistic Research Laboratory's (BRL) wind tunnel (now demolished) are in *Fluid Mechanics,* Raymond C. Binder, Prentice-Hall, 4th edition, pages 242–245. The shadow technique uses a spark timed to illuminate a photographic plate when a projectile is between the spark and plate. The projectile casts an ordinary shadow; the shock waves and wake eddies leave a shadow caused by refractive effects. A more complicated setup uses a Mach-Zehnder interferometer (*Fundamentals of Optics,* Jenkins and White, McGraw-Hill, 4th edition, pages 283, 604.

A shock wave from an explosive burst on the ground propagates as a hemispherical, invisible disturbance. An elevated explosive will create a spherical wave. The shape of the explosive itself is irrelevant; the shock wave becomes hemispherical or spherical at a distance of several basic body dimensions, e.g., a few diameters or cylinder heights. At large distances from the charge, the shock wave, though grossly weakened by the geometrical dissipation, still causes refractive index changes in air. Those changes are still evident at least at the 10 psi pressure level. The ground range where that pressure occurs depends on the weight of the explosive. That range grows very slowly with charge weight, being proportional to the cube root of the weight. Hence, the 10 psi level with one pound of explosive occurs at a ground range that is found in standard tables (10 ft.); to double that ground range requires that eight pounds be exploded.

At the shock wave's instantaneous position, the refractive index of air changes and light is bent. A moving ripple can sometimes be photographed against the background of a clear sky. The shock wave's appearance is less noticeable than a ripple dropped into a pool of water, but not always. More often, a moving break in the background scenery is noticed. To improve the location spotting of the shock wave, a large backdrop of striped sails is filmed at high speed. In multi-ton explosions, if the sun is high in the sky, the camera will film a black line racing over pale ground. This phenomenon is an expression of the refractive change of air and the setup is a form of shadowgraphy.

Advantages over the Prior Art

Photographic recording as used in the prior art is improved by the present invention. A photograph of a shock wave in plain air can be made, but, except for very strong shocks, nothing can be seen in a stopped frame. Only in moving film can the shock ripple be detected. Thus, a position measurement cannot be made on a stationary frame nor when the film is moving. These measurements can be taken if a backdrop of slanted stripes is filmed. The shock wave is revealed by the sight of broken zebra stripes. This scene is not the easiest to study visually, since the eye is interpreting numerous jagged breaks in the stripes as the momentary location of the shock wave. In the present invention, the shock wave appears as a continuous curve, smoothly moving and widening as a growing hemisphere.

If circumstances in the field allow shadowgraphy, it is largely a curiosity, not permitting measurements. It will reveal weaker secondary shocks, which is not an unuseful property and which this invention does not show well.

Interferometry is a laboratory technique, not movable in the field. It typically operates in windows of centimeters, whereas the present invention, as now practiced, functions on "windows" of two to four meters.

SUMMARY OF THE INVENTION

It is a primary object of the present invention to provide a process for visualization of a blast wave.

It is another object of the present invention to provide a process for visualization of a blast wave which is the shock wave propagating from a small or large explosion.

These objects and others not specifically enumerated are accomplished by a process for visualization of the blast wave, which is the shock wave resulting from an explosive charge, and is practiced by observing disturbance contours on a air-cloud and interpreting resulting graphical and calculated data to evaluate matters related to the explosive blast wave.

BRIEF DESCRIPTION OF THE DRAWINGS

The foregoing and other objects, aspects, uses, and advantages of the present invention will be more fully appreciated as the same becomes better understood when considered in connection with the following accompanying drawings, in which.

DESCRIPTION OF THE PREFERRED EMBODIMENT

Figure 1:
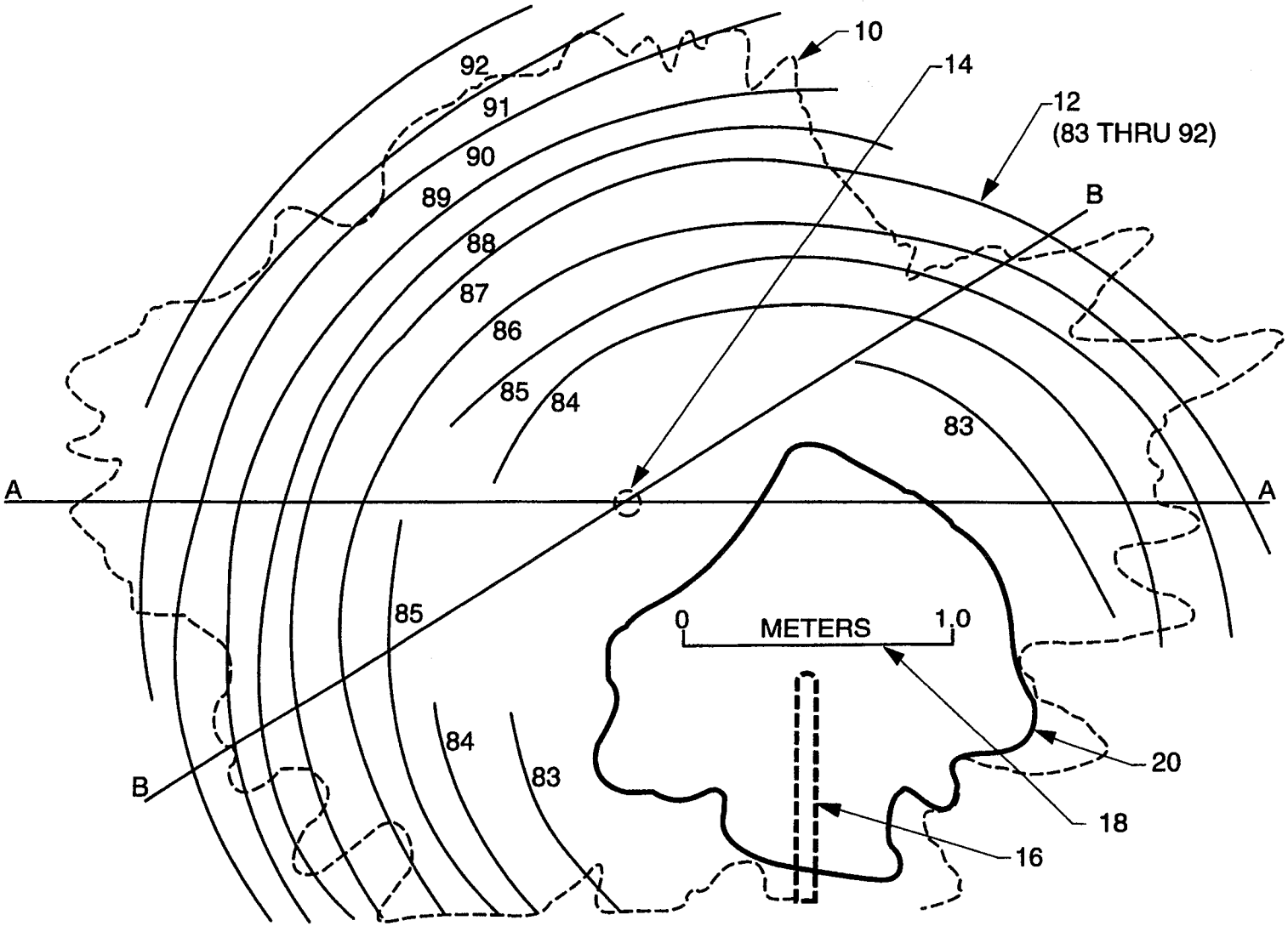
FIG. 1 shows a graphic representation of disturbance contours on a cloud, in accordance with the invention.

Referring now to the drawings, like reference numerals represent identical or corresponding parts throughout the several views.

The present invention, made by a serendipitous discovery that could have been made by many others, is a tested process for visualization of a blast wave. Applicant developed this process during extensive experimentation in fuel-air explosive matters. Reference is made to Applicant's pending U.S. patent application Ser. No. 07/953,165, filed Sep. 29, 1992, entitled FUEL AIR EXPLOSIVE CANISTER. In particular, Applicant set up shot no. 24 to create a fuel-air explosion. A combustible liquid was disseminated in the atmosphere, but the small charge did not initiate the usual detonation reaction of a cloud, and so the intended objective failed. However, photographic film of the event showed that a disturbance emerged from the fireball created from the small 70-gram charge used and produced a noticeable change in the cloud. The color of the cloud changed from a dark gray to a light gray as the disturbance propagated through it. The delineation of shade was plain to an observer. As will be explained, the observed optical changes were identified as the passage of the explosive's blast wave. Thus the observation produced a useful addition to the art of explosives. The failure that the Applicant studied must have been seen by numerous other individuals in the course of the past quarter-century in the field of fuel-air development. That its meaning was never appreciated is deemed proof that the inventive method is not obvious.

The process for visualization of the shock wave of the present invention includes a number of novel steps. In the usual manner of fuel-air explosive matters, liquid is disseminated into the atmosphere by the internal explosion of a central burster tube fracturing a jug of liquid and creating an expanding cloud of liquid droplets. A test charge is exploded in the outer extent of the cloud. The blast wave disturbs the color of the cloud but not its shape. The trace of the intersections of the shock bubble and the cloud reveals the progress of the blast wave.

In the development of the present process, several shots were observed to produce clouds having disturbance contours. FIG. 1 shows a dashed outline 10 of no. 61 cloud with disturbance contours 83 through 92 (collectively 12) overlying the cloud. Further, there is shown the position of the jug 14 which held the liquid, a post 16 on which was positioned a 118-gram test charge 17, a length scale 18, and a fireball 20. By properly orienting the jug 14, the test charge 17, and a high-speed camera (not shown), a disturbance, resulting from explosion of the test charge 17, can be photographed and traced as contours 12 and be used for quantitative measurement. A graphical representation can be produced for disturbance position vs. time, and also a graphic representation (not shown) of disturbance velocity vs. position. The measurements derived from these graphs are important in shock physics. And, though standard values have been accepted (see TECHNICAL REPORT ARBRL-TR-02555, Apr. 1984, by Kingery and Bulmash), pages 18–19, none of the developed measurement techniques in shock physics are considered to anticipate the inventive process.

Figure 2:
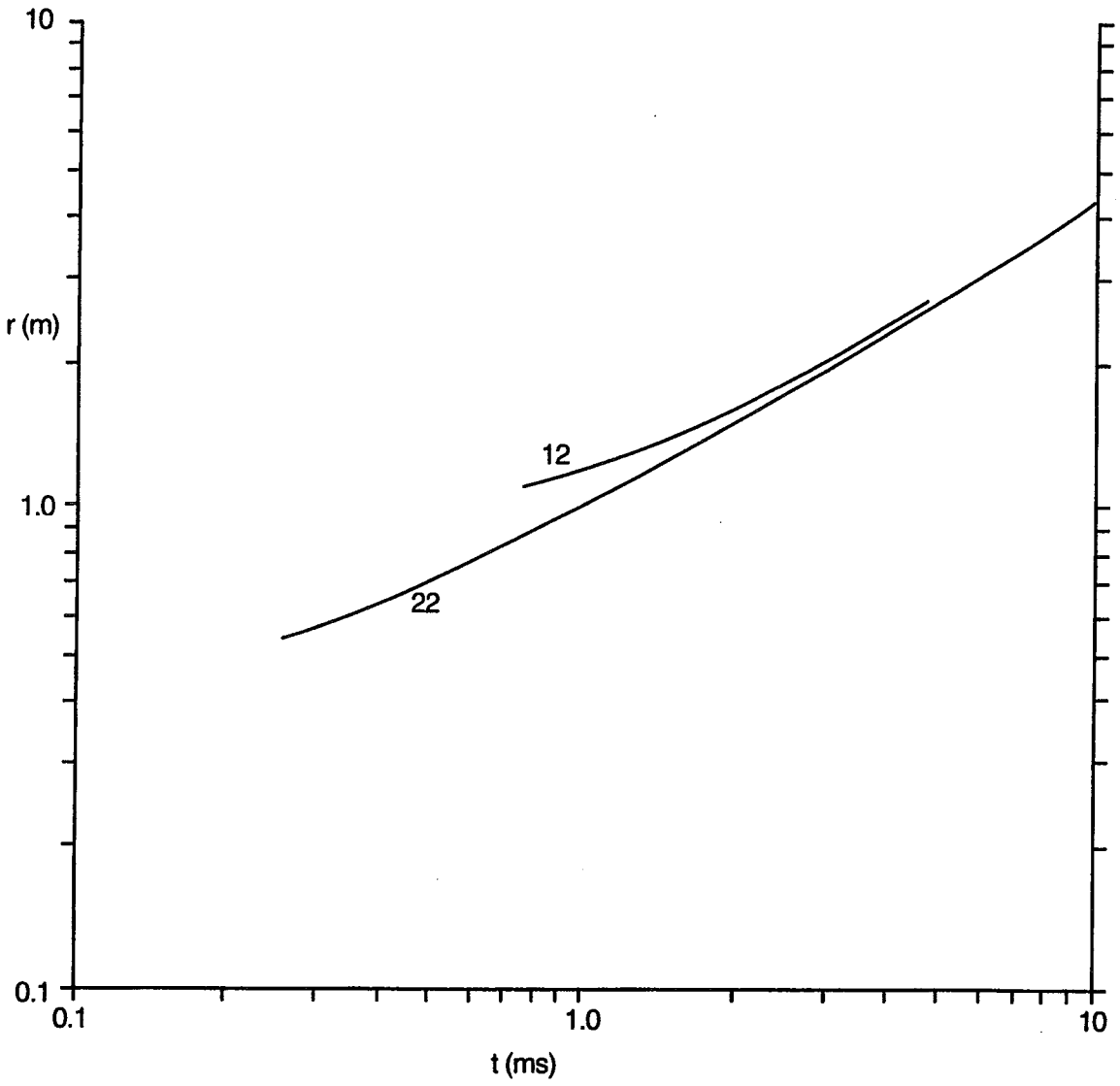
FIG. 2 shows a graphic representation of an identification of the disturbance as a blast wave.

FIG. 2 compares the progress of the disturbance contour 12 on cloud no. 61 to (scaled) standard values of the progress 22 of a blast wave from a 118-gram sphere of TNT. FIG. 2 shows experimental values 12 that are 7% high, indicating either that the disturbance 12 is traveling faster than a standard blast wave 22 or that there is a systematic bias to Applicant's measurements.

An error analysis estimates precision of reading a length scale in the scene at + or −5 %, and of reading the disturbance position at + or −3 %, and of film timing at + or −1 % for a standard estimate of error e of:

$$e = \sqrt{0.05^2 + 0.03^2 + 0.01^2} = 0.06$$

These errors pertain to a setup and are not basic limitations to the precision of the process. The fact that the experimental values are all one-sided implies that a systematic bias exists. One cause of bias might be that the fireball is abnormally large since it occurs inside a combustible cloud. The blast wave is initially moving through a hotter region than it would be in a fireball in air (or in a water cloud). Nevertheless, the overall agreement of experimental and standard curve supports the assertion that it is the blast wave that has been visualized. A simpler reason for the assertion is that the Applicant cannot suggest any alternative identification of the disturbance.

Applicant contends that following is an explanation of the disturbance in the cloud: A blast wave is normally invisible in clear air, but it does entrain gas and light particles, if present. This behavior means the density of the cloud immediately behind the blast wave is different than in the cloud in front of the blast wave, and, therefore, it has a different reflectance. The blast wave is the boundary surface of the altered reflecting regions, and so photography can reveal the progress of the blast wave through a sunlit cloud.

Under this explanation, it is obvious to one skilled in the art of explosives that the particular means for the formation of the fuel-air clouds or liquid-air clouds are not essential to the process. The visualization of the blast wave takes place because there is a reflecting particulate medium interjected into the wave's path. Thus, other means can be employed in this process. These other means offer other possibilities of ease of employment, accessibility of equipment and expansion of the dimensions of wave observation.

For example, an alternative for formation of the cloud is the use of a stationary fan spray from a line of atomizing nozzles. Another example is to hang two clear plastic sheets parallel to each other and to generate smoke between them. In any alternative, the test charge is preferably exploded inside the medium enclosure and at one end or edge thereof.

The intercepting medium should not be extremely thick, as no visualization occurs until the blast wave has broken out of the medium. A medium of uncontrolled extent would not be suitable, e.g., a tactical smoke cloud that is so large that the disturbance is hidden by the smoke intervening between the test charge and the camera.

The results of Applicant's experiments determined that, broadly, the steps of the process for visualization of the blast wave which is the shock wave resulting from an explosive charge, comprises the following steps: disseminating the combustible liquid into the atmosphere forming a liquid screen-cloud having an observable broadside and edges; detonating the explosive charge in the inner vicinity or adjacent the edges of the screen cloud whereby the generated blast wave from the charge propagates throughout the screen-cloud and whereby contours of the resulting disturbance in the formed screen-cloud are readily observable on the broadside; photographically filming the broadside; and projecting the developed film whereby graphical and calculated data are generated for evaluating matters related to the explosive blast wave.

EXAMPLES OF SUCCESSFUL AND UNSUCCESSFUL EXPERIMENTS

The explanation of the visualization of a blast wave suggests alternative means of generating the medium or screen which have been discussed above. Thus, it is important that these alternatives must not create an "infinitely" thick medium in which the test charge is fired.

With regard to the fuel-air means of generating the medium, the cautions are to have enough burster explosive mass to obtain fine droplets. A fuel/burster weight ratio range from 110 to 250 is satisfactory. (Note that for both reasons, thickness and drop size, visualization would not occur with rainfall as a medium.) Another failure that may occur with a fuel-air explosion is the improper selection of jug size and test charge weight. For example, with the use of a small bottle, resulting in a small cloud, and a large test charge, the fireball would engulf the whole cloud and there would be no visualization. A satisfactory combination is to use one liter of liquid as disclosed in Applicant's pending U.S. patent application Ser. No. 07/953,165, filed Sep. 29, 1992 (supra), and a test charge of 50–100 grams. Minor changes in any of these parameters may improve the range of observations. Observations have been seen from outside the fireball to the cloud edge. From such observations, it was calculated that the pressure when the blast wave reached the cloud edge was 5 psi.

On shot no. 62 several parameters were simultaneously changed in order to observe the effect of convenient substitutions and quantity of materials. For example, in place of a combustible fluid, yellow-dyed water was used. The explosive charge was reduced to 50 grams and placed at the expected distance from the bottle over which a blast wave might be visualized in a liquid of greater utility. The fireball was reduced, but otherwise, results were poor. The color of the cloud was gray, not yellow, and the disturbance contours were not of a very high contrast and could only be followed 1.5 meters of the 3.3 meters available on one side of the charge. It appears that water does not have the optical properties as favorable to the process as combustible fluid. The contour farthest from the 50-gram charge can be scaled to give the contour distance expected from a 1-kg charge and the pressure there read from standard tables. The distance, d, may be calculated from the following equation. The scaling is:

$$d = 1.47\left(\frac{1000}{50}\right)^{\frac{1}{3}} = 3.98\ m$$

At 4.00 meters from a 1-kg sphere of high explosive, tables list the pressure as 46.5 kPa or 6.74 psi. Thus, the water test is capable of visualizing a blast wave stronger than 7 psi. Sensitivity is better when combustible fluid is the medium, as three tests indicated a mean of 4.8 psi for the farthest contours, and all contours were at the cloud edge.

Obviously, numerous modifications and variations of the present invention are possible in light of the above disclosure. It is therefore to be understood that the present invention can be practiced otherwise than as specifically described herein and still will be within the spirit and scope of the appended claims.

What is claimed is:

1. A process of visualization of a blast wave by observing disturbance contours on a cloud, comprising in combination, the following steps:

setting up and dispensing an interceptive medium having an observable broadside, detonating an explosive charge in the vicinity of the medium, using a means for creating the disturbance contours on the cloud, an image of the broadside of the medium being formed, projecting the formed image onto a recording means and copying the recorded image, and graphically plotting distance and time pertaining to the recorded image thereby producing data related to the visualization of the explosive wave.

2. A process as defined in claim 1 wherein the interceptive medium is a screen.

3. A process as defined in claim 2 wherein the screen consists of particles being dispersed within the blast wave.

4. A process as defined in claim 3 wherein the particles are explosively dispersed liquid droplets.

5. A process as defined in claim 3 wherein the particles are nozzle dispersed liquid droplets.

6. A process as defined in claim 3 wherein the particles are smoke particles.

7. A process as defined in claim 3 and includes hanging of transparent sheets of materials whereby the particles are confined therebetween.

8. A process for visualization of a blast wave which is a shock wave resulting from an explosive charge, comprising in combination, the following steps:

disseminating a combustible liquid into the atmosphere forming a liquid screen-cloud having an observable broadside and edges, detonating the explosive charge in the inner vicinity or adjacent the edges of the screen cloud whereby the generated blast wave from the charge being spread throughout the screen-cloud and whereby contours of the resulting disturbances in the formed screen-cloud being readily observable on the broadside thereof, photographically filming an image on the broadside, and processing the developed film whereby resulting graphical and calculated data being generated for evaluating matters related to the visualization of the explosive blast wave.

9. A process of visualization of a blast wave, comprising in combination, the following steps:

disseminating a combustible liquid into the atmosphere forming a liquid screen-cloud having an observable broadside and edges, the screen-cloud consisting of explosively dispersed liquid droplets, detonating an explosive charge adjacent the edges of the screen-cloud whereby disturbance contours being created on the formed explosive blast wave, the formed image on the blast wave being readily observable on the broadside thereof, photographically filming the formed image, processing the developed film, and generating graphical and calculated data for evaluating matters pertaining to the visualization of the explosive blast wave.

* * * * *